United States Patent [19]

Stiller et al.

[11] Patent Number: 4,586,660

[45] Date of Patent: May 6, 1986

[54] PROCESS FOR SEPARATING ANTHRACITE COAL FROM IMPURITIES

[76] Inventors: David W. Stiller; Alfred H. Stiller, both of R.D. #1, Box 126, both of White Haven, Pa. 18661

[21] Appl. No.: 605,256

[22] Filed: Apr. 30, 1984

[51] Int. Cl.[4] ..... B02C 19/12

[52] U.S. Cl. ..... 241/24; 241/77

[58] Field of Search ..... 241/21, 24, 79.1, 77, 241/81

[56] References Cited

U.S. PATENT DOCUMENTS

| | | | |
|---|---|---|---|
| 1,338,845 | 5/1920 | Schutz | 241/24 |
| 3,908,912 | 9/1975 | Irons et al. | 241/24 X |
| 4,132,365 | 1/1979 | Verschuur | 241/24 X |
| 4,252,638 | 2/1981 | Bender et al. | 241/24 X |
| 4,432,868 | 2/1984 | Aldrich | 241/24 X |

*Primary Examiner*—Mark Rosenbaum

*Attorney, Agent, or Firm*—Anthony J. Dixon

[57] ABSTRACT

A process for treatment of anthracite coal when combined with cinders and/or klinker type ash produced by old cleaning plant boilers comprising sizing of the mixture and magnetic separation of the ash from the mixture thereby improving the combustion value. Use for treatment in existing anthracite and cinder waste piles is disclosed.

3 Claims, 1 Drawing Figure

PROCESS FOR SEPARATING ANTHRACITE COAL FROM IMPURITIES

BACKGROUND OF THE INVENTION

I. Field of the Invention

The present invention relates to a process for treatment of anthracite coal.

More particularly it relates to magnetic separation of previously processed anthracite coal from klinker type ash or cinders, which is an industrial waste product of pre 1960, anthracite treatment centers or coal breakers.

II. The Prior Art

Anthracite coal which is found predominantly in Northeastern Pennsylvania is unique among coals in that it has a very high fixed, non-volatile carbon content. As a result, this coal does not lose an excessive quantity of its combustion value upon standing in ambient air conditions. It remains stable for long periods of time, perhaps centuries. This is not true of Bituminous and Lignite coal found elsewhere in the world.

Further, each coal type, depending on its properties, caused development of distinct methods of production, liquification and reclamation.

In the early production of anthracite, coal removed from the mine was transported to coal breakers where it was crushed, cleaned, sized and washed.

During this time frame, that is the 19th and early to mid 20th centuries, only the larger sizes where considered commercially valuable. These sizes were designated "pea" or "chestnut" coal.

Smaller coal pieces or chips and washings were considered waste and were consequently discarded. Today these products are valuable due to the use of improved coal fired boilers, stokers which use smaller sized coal as well as steam generators for electric plants and gasification units being developed in the overall synthetic fuel advances being made throughout the world. Yet these previous considered waste products are generally not found alone and separated, but rather mixed with other waste or undesirable materials.

During this same time frame, the coal treatment plants or breakers, were fired by the most available and cheapest fuel-anthracite coal. The energy derived from burning anthracite produced the power to operate the entire processing plant. As a result, a second waste product was produced, boiler ash; a klinker-type ash. This was discarded in the same waste areas as the waste chips of anthracite previously discussed.

Many times, the mixture was simply piled into great heaps which now dot the landscape of the anthracite region. Other times, it was used to make beds for railroads. Much was washed into streams and rivers creating large silt washes. The coal in this mixture retains a high combusition rating and when mixed with refined coals, usually anthracite, is used to power industrial processes.

An economical method is needed which would increase the combustion value of the waste anthracite-klinker type cinder mixture. This could best be accomplished by removal of the cinders from the previously mentioned mixture thereby permitting the recovered anthracite to be used as a primary fuel.

A method is needed to create economic feasibility to renewal and use of the unsightly heaps and silt washes which dot the landscape of anthracite regions such as Northeastern Pennsylvania.

The present invention provides such a method and solves these problems long prevalent in the field of anthracite technology.

Processes presently patented for improving coal quality can best be characterized by U.S. Pat. No. 3,938,966 and U.S. Pat. No. 4,120,665 both issued to James K. Kindig. The primary focus of these patents is to remove pyrite, i.e. the major inorganic sulfur-containing component from bituminous coal. They are not designed to remove preformed, existing ash or cinders from a mixture such as the previously mentioned waste.

Further, these processes require pretreatment and preheating of the coal to be operable which is not feasible when dealing with preprocessed coal. Further, these patents although they use magnetics generally, treat raw coal with metal containing compounds to enchance the magnetic susceptibility of the contaminates for magnetic removal.

None of these steps is utilized in the present invention.

SUMMARY OF THE INVENTION

A method has now been found to separate anthracite coal from klinker-type ash by use of known sizing techniques combined with magnetic separation.

The process of the present invention comprises:

(a) means for separating the anthracite and klinker-type cinder ash mixture from other refuse such as rocks, boulders, tree stumps, brush and the like;

(b) means for grinding the mixture to a uniform size and consistency;

(c) means for removing oversized particles from the mixture of Step b;

(d) subjecting said sized mixture to a magnetic separation chamber, whereby discarded anthracite-cinder mixtures, are separated into cinders and anthracite.

The separation means can be any known screening technique so as to initially remove large rocks, stumps, sticks and the like from the desired feedstock which usually is found as long standing, discarded waste heaps or washes. Conventional grinding as in Step B provided not only a uniform inlet feed to the magnetic separation step but also overcomes the gravitational forces which may prevent magnetic separation of large particles. Anthracite coal has essentially no magnetic susceptibility. When anthracite was burned in the old fashioned boilers such as existed in coal separators or breakers of the pre-1950 era, iron and iron oxides from the grating systems and burning chambers were trapped in the glass-like structure of the klinkers and cinders lending them magnetic properties. The more modern technology of current boilers and power units which utilize anthracite fuel do not produce a substantially magnetic klinker-type ash. Grinding in Step B reduces the particle mass-to-magnetic susceptibility ratio permitting more efficient removal of the magnetic cinders in Step C. Thereby the feed mixture is separated into anthracite coal and magnetically susceptible cinder-type ash.

It is further envisioned that these units can be placed on flatbed truck, trailer or rail car and moved to the waste heap location so as to reduce reclamations costs. These and other advantages will be more readily seen in a review of the drawings and description of the preferred embodiment which follows.

DESCRIPTION OF THE PREFERRED EMBODIMENT

Figure 1:
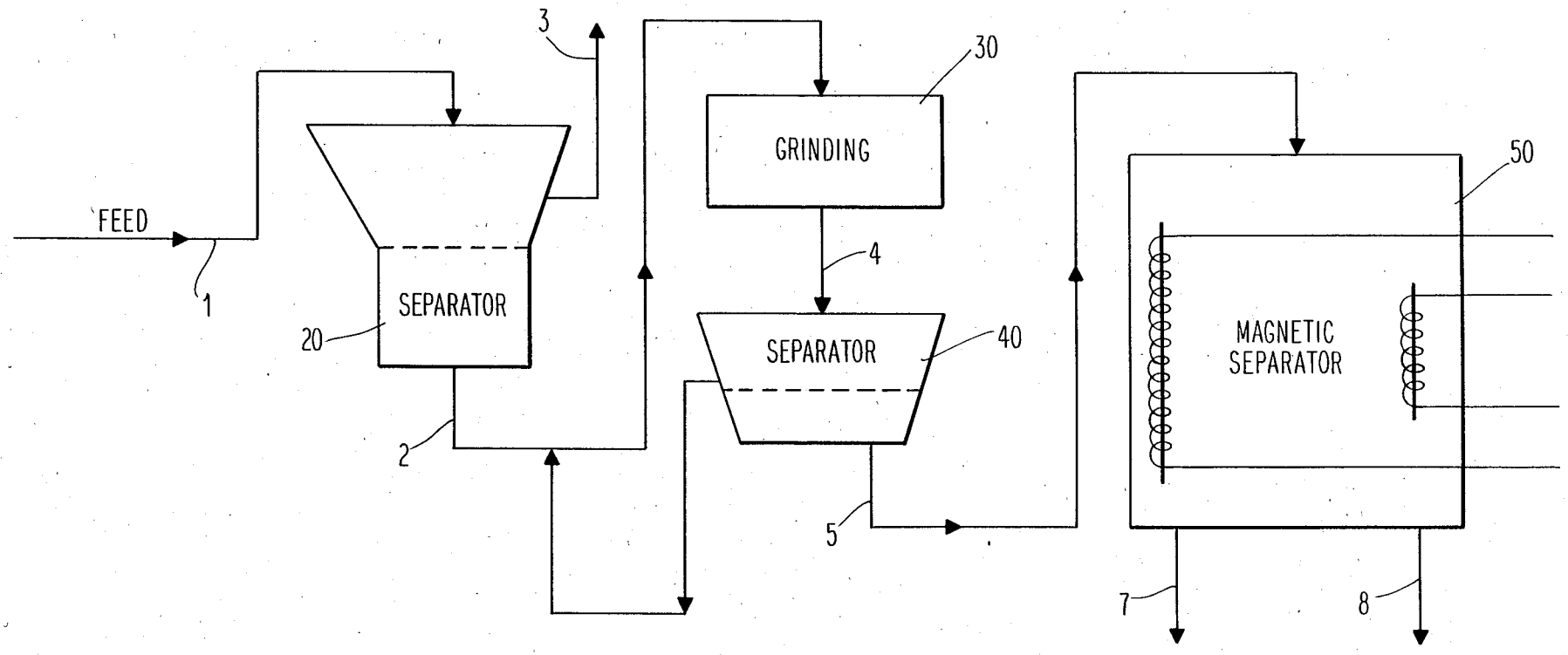
FIG. 1 is a flow diagram of the process of the present invention.

The research which led to the invention of the present process has indicated that boiler cinders or klinker type ash have appreciated magnetic susceptibility which allows for its removal from non-magnetic anthracite coal using classical magnetic separation techniques, a previously unknown use and novel application for a classical separation method. Such techniques will allow for separation of usable anthracite from said unuseable ash.

Referring now to FIG. 1, a flow sheet of the process can be seen.

Feedstock to the process flow along line 1 which is a standard solid transfer conveyor of a type presently commercially available and proceeds into hopper of separator 20. This is a first stage separation to provide for removal of impurities other than cinder ash such as stumps, roots, tree branches, boulders, rocks and the like. Due to the nature of the rough feedstock which has been lying in the open, the first stage separation is necessary. An example of this type of separator is the standard type screen separator presently manufactured.

Outlet from the first stage separator flows through line 2, another conveyor strip, to the grinding stage; depicted as 30.

Here the once separated coal, ash, and klinkers are ground through standard techniques to reach a uniform consistency. This is preferably a particle size from at least about −28 mesh.

Once ground, the material flows via conveyor 4 to the second stage separator, 40, a screen-type separator.

Here, unacceptable particles are removed and recycled to grinding stage 30, although this material can also be removed totally without affecting the overall process.

Material of acceptable size then flows via conveyor to the magnetic separation chamber 50, wherein the klinker type or cinder type ash is separated from the anthracite due to its magnetic susceptibility. Such separators are readily available in the market place. Good examples would be the designs from Stearns Magnetics, Inc. of Cudahy, Wis.

Anthracite coal is removed via conveyor 8 to be shipped out as fuel stock.

Naturally, various modifications to the flow diagram can be made without departing from the scope of the present invention and such variations are interpreted to be within the scope of the present invention. Further, the entire unit can be mounted on a trailer or flatbed truck, rail car, lowboy or the like and taken from one waste site to another. In this way the non-useable material need not be moved at all.

What is disclosed herein is a process with a definite scope, purpose and application which will allow economically feasible coal recovery and simultaneous environmental improvement. The process is by its nature limited to anthracite coal combined with klinker type cinders of the type produced in pre-1950 coal fixed units and it is not applicable to flyash, clays, slate or pyrites.

What is claimed is:

1. A process for separating a first mixture including previously mined anthracite coal, klinker-type cinder ash and other refuse comprising a. separating said first mixture to produce a refuse portion and a second mixture consisting of anthracite and klinker-type cinder ash, b. reducing the average particle size in said second mixture to a uniform size, c. subjecting said second mixture to a separating magnetic field to produce a klinker-type cinder ash portion and an anthracite coal portion.

2. The process of claim 1 wherein said separating step, a, further comprises a conventional sized-screen separator.

3. The process of claim 1 wherein said reduction step, b, further comprises a conventional or solids grinder and said uniform size is in the range from −10 mesh to −28 mesh.

* * * * *